US009708831B2

(12) United States Patent
Mathofer

(10) Patent No.: US 9,708,831 B2
(45) Date of Patent: Jul. 18, 2017

(54) HANDLE UNIT

(71) Applicant: Huf Huelsbeck & Fuerst GmbH & Co. KG, Velbert (DE)

(72) Inventor: Reinhold Mathofer, Wuelfrath (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 0 days.

(21) Appl. No.: 15/229,866

(22) Filed: Aug. 5, 2016

(65) Prior Publication Data

US 2017/0037655 A1 Feb. 9, 2017

(30) Foreign Application Priority Data

Aug. 6, 2015 (DE) ..... 10 2015 112 953

(51) Int. Cl.

| | |
|---|---|
| ***E05B 17/18*** | (2006.01) |
| ***E05B 81/90*** | (2014.01) |
| ***E05B 17/14*** | (2006.01) |
| ***E05B 77/34*** | (2014.01) |

(Continued)

(52) U.S. Cl.

CPC ..... *E05B 17/183* (2013.01); *E05B 17/14* (2013.01); *E05B 77/34* (2013.01); *E05B 81/90* (2013.01); *E05B 85/16* (2013.01); *E05B 79/06* (2013.01); *Y10T 70/796* (2015.04); *Y10T 70/7983* (2015.04); *Y10T 70/8649* (2015.04)

(58) Field of Classification Search

CPC ..... E05B 17/183; E05B 85/16; E05B 77/34; E05B 17/14; E05B 17/18; E05B 17/181; E05B 17/142; E05B 79/06; E05B 81/90; Y10T 70/7955; Y10T 70/796; Y10T 70/7977; Y10T 70/7983; Y10T 70/8649

USPC ..... 70/208, 210, 423–428, 455

See application file for complete search history.

(56) References Cited

U.S. PATENT DOCUMENTS 2,096,568 A * 10/1937 Snively ..... E05B 17/183 70/455
3,625,035 A * 12/1971 Brummer et al. ..... H01H 9/04 70/365
4,709,567 A 12/1987 Appelbaum (Continued)

FOREIGN PATENT DOCUMENTS

DE 199 43 497 A1 3/2001
DE 10 2008 031 218 A1 1/2010

(Continued)

OTHER PUBLICATIONS

Search Report of Related European Application No. EP 16 17 5987 dated Dec. 21, 2016, 8 pages.

*Primary Examiner* — Lloyd Gall
(74) *Attorney, Agent, or Firm* — Fay Sharpe LLP

(57) ABSTRACT

A handle unit having a handle element for opening and/or closing a lock provided on a moving part includes a lock cylinder, which is protected by a covering cap, and an attachment element, on which the covering cap is releasably disposed. The covering cap has at least one guide projection on the interior thereof, which bears on a guide surface when in the snap-in position, which is formed on the attachment element and is complementary to the guide projection. The attachment element forcibly guides the movement of the covering cap when the covering cap is released, such that the at least one guide projection moves along the complementary guide surface, away from the attachment element.

10 Claims, 3 Drawing Sheets

(51) Int. Cl.
*E05B 85/16* (2014.01)
*E05B 79/06* (2014.01)

(56) References Cited

U.S. PATENT DOCUMENTS

| | | | | | |
|---|---|---|---|---|---|
| 5,758,529 | A * | 6/1998 | Chhatwal | E05B 15/02 | 70/160 |
| 6,499,327 | B1 * | 12/2002 | Sugimoto | E05B 17/142 | 70/345 |
| 2005/0235712 | A1 * | 10/2005 | Yukihara | B60Q 3/004 | 70/252 |
| 2008/0190157 | A1 * | 8/2008 | Mizuno | E05B 17/183 | 70/455 |
| 2013/0205848 | A1 * | 8/2013 | Langenberg | E05B 17/183 | 70/455 |
| 2015/0114060 | A1 * | 4/2015 | Rosenau | E05B 77/34 | 70/431 |
| 2016/0145910 | A1 * | 5/2016 | Beck | E05B 79/04 | 70/455 |

FOREIGN PATENT DOCUMENTS

| | | | |
|---|---|---|---|
| DE | 10 2012 103 936 | A1 | 11/2013 |
| EP | 2 518 245 | A2 | 10/2012 |
| FR | 2 780 084 | A1 | 12/1999 |
| FR | 2 819 539 | A1 | 7/2002 |

* cited by examiner

HANDLE UNIT

BACKGROUND

The invention addresses a handle unit for a moving part of a vehicle, in particular for a door or a hatch, having a moving handle element for opening and/or closing a lock provided on the moving part, a lock cylinder, which is protected toward the exterior by means of a covering cap, and an attachment element, on which the covering cap is releasably disposed, wherein the attachment element has at least one elastic snap-fit hook and the covering cap has at least one snap-fit recess, and wherein the at least one snap-fit hook is designed such that it is complementary to the at least one snap-fit recess, and with which it engages when the covering cap is in a snap-in position.

A handle unit of the type described above is known, for example, from DE 10 2008 031 218. A modern handle unit of this type for door or hatches of a vehicle is mainly operated via electronic means using radio, infrared or RFID technology. As a result, the conventional mechanical lock cylinder of the handle unit is only of secondary importance. Furthermore, there are keyless-go systems, which render even the use of the remote control for the locking system via a transmitter key superfluous.

In the event of a power failure, or other electronic disruptions in the motor vehicle, there must still be a possibility for opening the motor vehicle without electronic means as well. For this reason, lock cylinders are still provided on at least the driver door, which are, however, very rarely operated with a mechanical key on a handle unit of this type. In order to protect the lock cylinder, and to cover it from the exterior, covering caps are known, which are releasably attached to the handle unit or the cylinder housing of the lock cylinder. The covering caps cover the lock cylinder toward the exterior of the handle unit, or the door of the vehicle, respectively, and must then be removed or dismantled when the door or the hatch must be opened by the lock cylinder with a mechanical key. A tool is usually necessary to dismantle the covering cap, which in many cases is implemented by the mechanical key. When the covering cap is dismantled from the handle unit, there is the problem that the covering cap is released from the handle unit in an uncontrolled manner, and is moved thereby toward the door or the hatch, or toward the body panel of the door or hatch, and strikes against it, which may result in damage to the paint and/or the panel.

The invention assumes the objective of creating a solution that provides a handle unit in a simple and economical manner, which prevents the problem of damaging the vehicle panel known from the prior art, and by means of which an improved attachment to a part of the handle unit is enabled.

BRIEF SUMMARY

With a handle unit of the type described in the introduction, the objective is achieved according to the invention in that the covering cap has at least one guide projection, which bears on a guide surface when in the snap-in position, which is formed on the attachment element and is complementary to the guide projection, wherein, when the covering cap is released, the attachment element forcibly guides the movement of the covering cap such that the at least one guide projection moves along the complementary guide surface and away from the attachment element. As set forth in the invention, the expression "forcibly guided" is to be understood to mean a movement in which the freedom of movement is limited in at least one spatial direction, and occurs such that it is guided in the manner of a connecting link. Furthermore, as set forth in the invention, the expression "complementary" is to be understood to mean that something is designed such that it corresponds to something else, such that the functionality is first ensured by a correspondingly complementary design. The expression "complementary" in this sense means that a shape of a component is adapted to the shape of another component, in order to ensure thereby, the desired functionality when the two components interact. Lastly, in the framework of the present invention, the moving part of a vehicle is understood, in particular, to be an outer door, a side door, a hatch, or a glove box, or suchlike. The vehicle can be, in particular, a passenger automobile, a truck, a ship or an airplane.

Advantageous and beneficial designs and further developments of the invention can be derived from a review of the specification and drawings.

A handle unit is provided by the invention, which is distinguished by a functional construction, and has a simple and economical structure. While the guide projection bears on guide surface when the covering cap is in the snap-in position, and is supported there, a forcibly guided movement occurs when the covering cap is released, in which the guide projection of the covering cap is moved along the guide surface of the attachment element. Because the guide surface is designed such that it faces away from the attachment element, the covering cap is forced away from the attachment element when it is released, and thus is moved away from the handle unit, by means of which, in contrast to the handle units known from the prior art, there is no longer the danger that the covering cap will strike against the panel of the door or the hatch, and damage the paint thereby. The specially designed guide surface of the attachment element ensures, according to the present invention, that the covering cap is guided away from the panel of the door or hatch when it is released or dismantled from the handle unit, such that there is no possibility of damage to the paint or the panel.

In terms of the design for the handle unit according to the invention, it has proven to be particularly effective that the at least one guide surface of the attachment element and the at least one guide projection of the covering cap are designed such that they are curved. In this manner, the covering cap can be dismantled from the handle unit as the result of the pivotal movement of the covering cap associated with the curve, requiring relatively little space.

In the design of the invention, it is provided that the attachment element has a support on one of its longitudinal ends, on which at least a section of a longitudinal end of the covering cap rests. Depending on the orientation of the guide surface of the attachment element, either a pulling or pivoting movement can be implemented thereby, in order to release the covering cap from the handle unit.

It is of particular advantage when the support and the at least one guide surface, which is disposed adjacent to the support and runs substantially parallel thereto, collectively form a pivot bearing for the covering cap, about which the covering cap is supported such that it can pivot in relation to the lock cylinder. Consequently, the covering cap can be pivoted outward, in order to expose the lock cylinder disposed thereunder, without there being the danger thereby that the covering cap could damage the paint or panel of the door or the hatch.

In another design of the handle unit according to the invention, the invention provides, in an advantageous manner, that the attachment element has at least two movement limiting bars, between which at least one movement limiting projection of the covering cap is disposed, wherein the at least two movement limiting bars block a movement of the covering cap transverse to the direction of the forcibly guided movement when the covering cap is released. As a result of the measure of the at least two movement limiting bars interacting with the movement limiting projection disposed lying therebetween, the covering cap can only move along one direction, specifically along the guide surface, but not transverse or laterally to the guide surface.

In a further design of the handle unit, the invention provides that at least one elastic, movable locking arm is formed in the interior of the covering cap, which engages with a locking recess, which is formed on the attachment element and is complementary to the locking arm of the covering cap, such that a movement of the guide projection along the guide surface is blocked.

In particular, the covering cap is disposed in the snap-in position when the locking arm engages in the locking recess.

A particularly compact and space saving design is obtained in the design of the invention in that the attachment element has a housing for accommodating the lock cylinder.

As an alternative to a curved guide surface, a straight guide surface may be provided, wherein then, in the design of the invention, in addition to the at least one guide projection, which is formed on a longitudinal end of the covering cap, a secondary guide projection is formed in the middle of the covering cap, or on a longitudinal end of the covering cap lying opposite the guide projection, wherein the attachment element has a secondary guide surface, which is complementary to the secondary guide projection, and by means of which the secondary guide projection is guided when the covering cap is released. In this manner, the covering cap can only move away from the handle unit when being dismantled, or toward it when being installed. A pivotal movement or a lateral movement of the covering cap, however, is not possible, due to the guide surface and the secondary guide surface.

An economical possibility for the design of the attachment element is provided by the invention in that the attachment element is releasably attached to a handle mount, or is designed as a component section of a handle mount for the handle unit. The component section variation is understood to be an embodiment in which the attachment element is an integral part of the handle mount.

Lastly, the invention provides, in another design of the handle unit, that an opening is formed in covering cap, through which a tool can be inserted into the interior of the covering cap, such that the at least one elastic snap-fit hook can be pushed out of its snap-in position such that the snap-fit hook becomes disengaged from the snap-fit recess, and the covering cap can be released from the handle unit. Alternatively, the tool can move the snap-fit recess away from the snap-fit hook, which requires that the snap-fit recess is formed on an elastic moving part. In general, it is the case that the tool ends up in the interior of the covering cap via the opening, in order to release a snap-fit connection between the covering cap and the attachment element for dismantling the covering cap.

It is to be understood that the features specified above and still to be explained below can be used not only in the respective specified combinations, but also in other combinations or in and of themselves, without abandoning the scope of the present invention. The scope of the present invention is only defined by the Claims.

BRIEF DESCRIPTION OF THE DRAWINGS

Further details, features and advantages of the subject matter of the invention can be derived from the following description in conjunction with the drawings, in which, by means of example, preferred exemplary embodiments of the invention are depicted. Therein.

DETAILED DESCRIPTION

Figure 1:
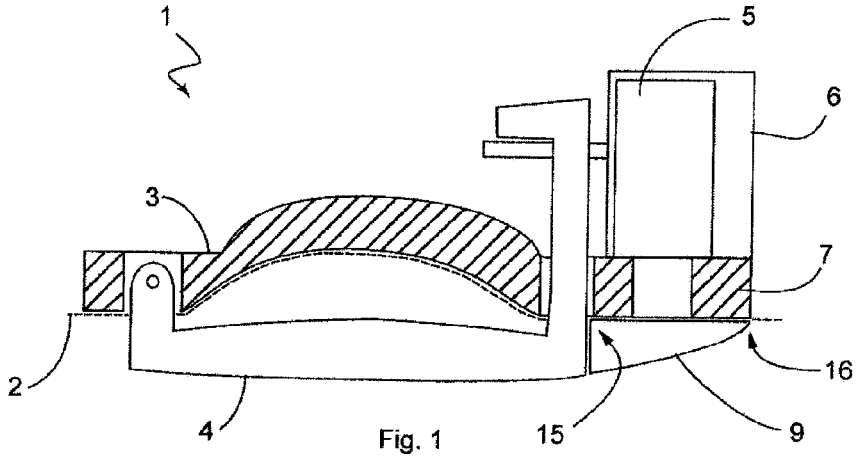
FIG. 1 shows a sectional view of the assembly of a handle unit in a door of a motor vehicle, having a lock cylinder and an attachment element, wherein a covering cap attached to the attachment element is provided for covering the lock cylinder.
Figure 2:
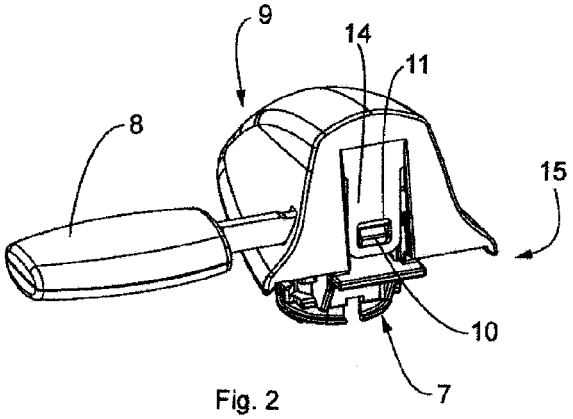
FIG. 2 shows the covering cap attached to the attachment element, and a mechanical key for releasing the covering cap, in a perspective view.

FIG. 1 shows an assembly for a handle unit 1 inside a door 2 of a motor vehicle, wherein the door 2 is indicated, as a painted outer panel of the motor vehicle, by a broken line. The handle unit 1 has a handle mount 3, which is substantially located on the inside of the door 2. The door 2 has numerous openings and through-holes, such that the control elements for the handle unit 1 are attached to the outside of the door 2, and can be connected through the openings to the handle mount 3.

With reference to FIGS. 1 to 12, in which a first exemplary embodiment of the handle unit 1 according to the invention is shown, a control element for a handle element 4 designed in the manner of a handle is provided for the manual operation of the handle unit 1. The handle element 4 interacts with a lock cylinder 5, such that when the lock cylinder 5 is locked, the handle element cannot be effectively operated. The lock cylinder 5 is disposed on the inside of the door 2 of the motor vehicle, and is accommodated in a cylinder housing 6, which is formed as an integral part of the an attachment element 7. The lock cylinder 5 can be attached to the handle mount 3 using the attachment element 7. In the event of a power failure, for example, a mechanical key 8 can be used to actuate the lock cylinder. A covering cap 9 is provided as protection for the lock cylinder 5, which is disposed in the extension of the handle element 4, and is adapted to the shape of the handle element 4. In order to give the handle unit 1, with the covering cap 9 designed as a plastic injection molded component, a high-quality appearance, the attachment of the covering cap 9 is covered, and implemented via internal snap-fit geometries, as shall be explained in greater detail below.

The covering cap 9 is releasably disposed on the handle unit 1 via the attachment element 7. More precisely, the covering cap 9 is releasably attached to the attachment element 7, wherein, in the depicted exemplary embodiment, the attachment element 7 itself is releasably attached to the handle mount 3. Alternatively, it would also be conceivable for the attachment element 7 to be designed as a component section of the handle mount 3, thus as an integral part of the handle mount 3. In order for the covering cap 9 to be able to be releasably attached to the attachment element 7, the attachment element 7 has an elastic snap-fit hook 10. As can furthermore be seen in FIGS. 2 to 4, a snap-fit recess 11 is formed in the covering cap 9, in which the snap-fit hook 10 engages in order to secure the covering cap 9 in a snap-in position (see FIG. 2) on the attachment element 7.

In order to disengage the snap-fit hook 10 on the attachment element 7 from the snap-fit recess 11 in the covering cap 9, a tool must be used, which can be the mechanical key 8, or a tool having a similar shape, in the present case. For this, an opening 12 is formed in the covering cap 9, through which the mechanical key 8 can be inserted into the interior of the covering cap 9. The snap-fit recess 11, which is formed in an elastic, moving flap 14, can then be disengaged from the snap-fit hook 10 using the mechanical key 8. The flap 14 is bent elastically to the side thereby, such that the snap-fit hook 10 is disengaged from the snap-fit recess 11. In this manner, the covering cap 9 can move, at least at its longitudinal end 15, on which the snap-fit recess 11 and the snap-fit hook 10 are formed on the covering cap 9 and the attachment element 7, in relation to the attachment element 7, as is shown, for example, in FIG. 3, in which the released longitudinal end 15 of the covering cap 9 is moved away from the longitudinal end 15 of the attachment element 7. In contrast, on the other longitudinal end 16, the covering cap 9 is still retained on the attachment element 7, wherein a guided movement of the covering cap 9 occurs at this longitudinal end 16, as shall be described below.

Figure 3:
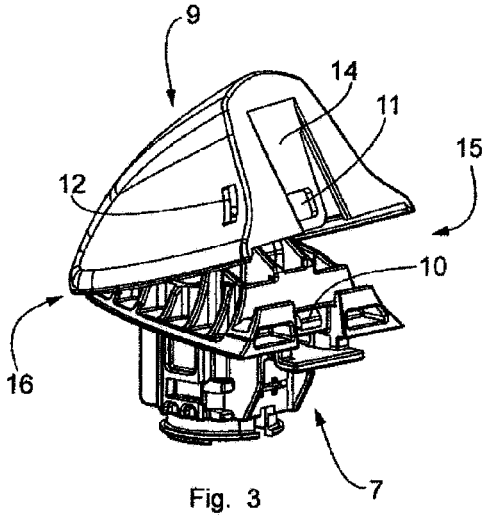
FIG. 3 shows a perspective view of the covering cap released from the attachment element.
Figure 4:
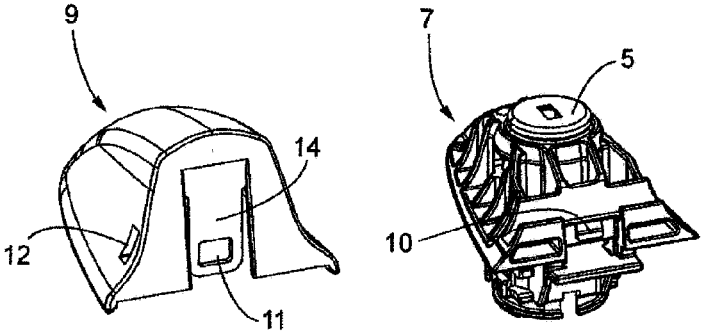
FIG. 4 shows an exploded view of the components of the handle unit according to the invention shown in FIG. 3.
Figure 5:
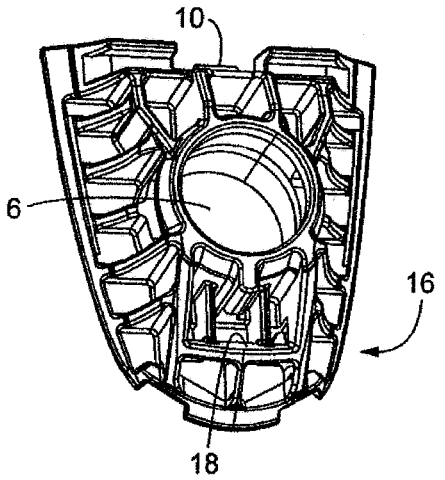
FIG. 5 shows the attachment element from FIG. 3 in a perspective view.
Figure 6:
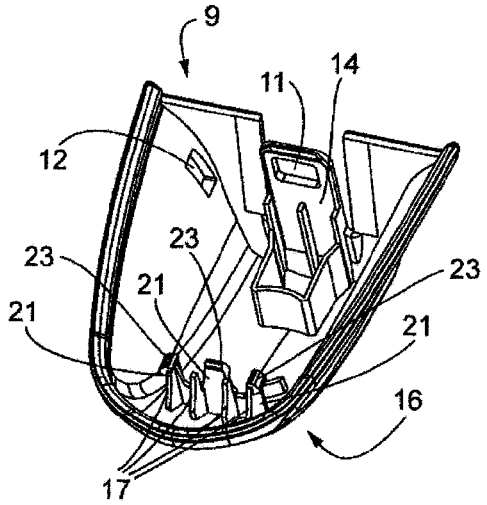
FIG. 6 shows the covering cap from FIG. 3 in a perspective view.
Figure 7:
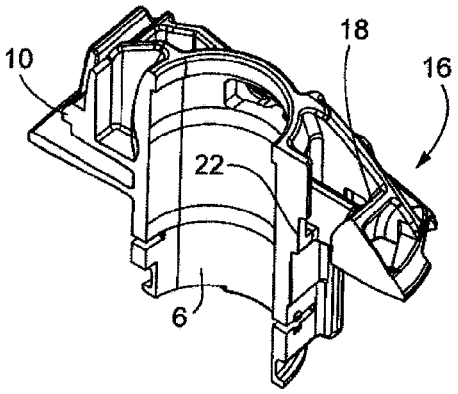
FIG. 7 shows a perspective sectional view of the attachment element from FIG. 5.
Figure 8:
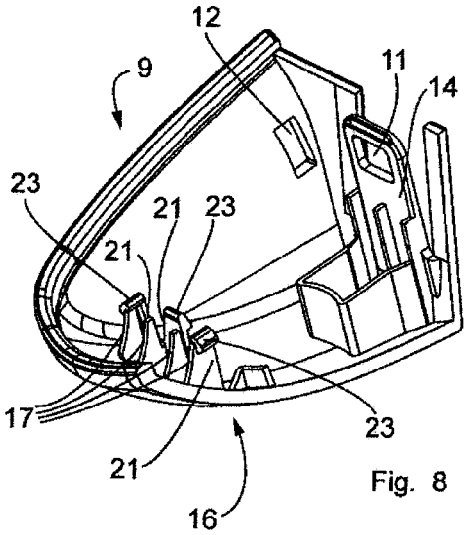
FIG. 8 shows a perspective sectional view of the covering cap from FIG. 6.
Figure 9:
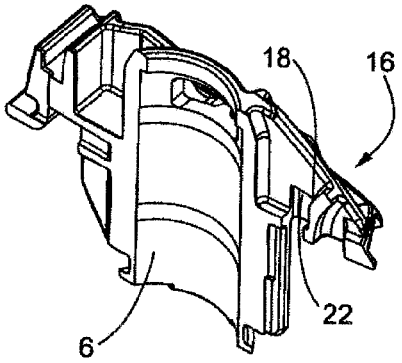
FIG. 9 shows another perspective sectional view of the attachment element from FIG. 5.
Figure 10:
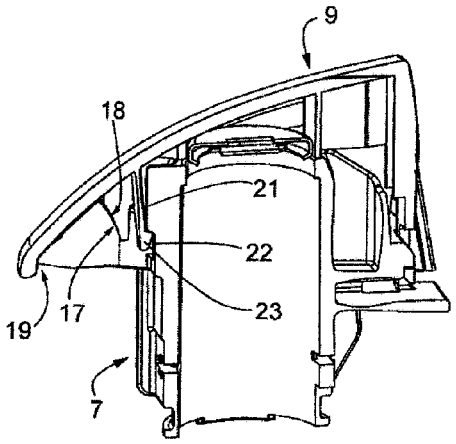
FIG. 10 shows a lateral sectional view of the attachment element and the covering cap in a snap-in position.
Figure 11:
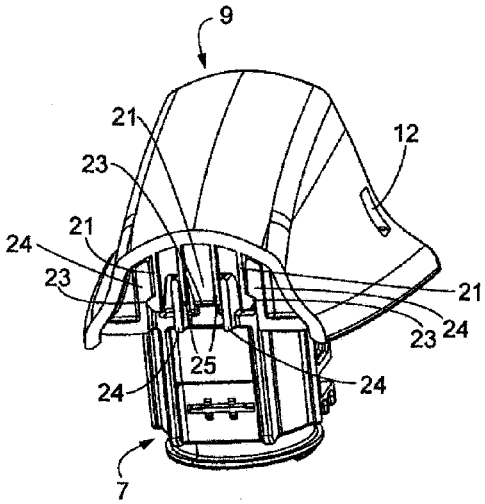
FIG. 11 shows a cutaway front view of the attachment element and the covering cap in a snap-in position.
Figure 12:
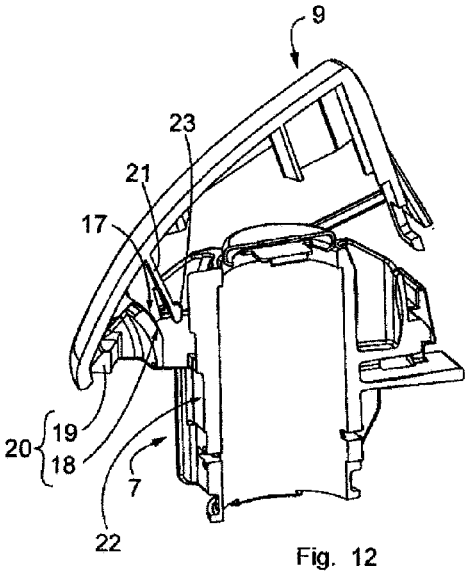
FIG. 12 shows a later sectional view of the attachment element and the covering cap after it has been released from the attachment element.

It can be seen in FIGS. 5 to 12 that the covering cap 9 has numerous guide projections 17 on the inside, wherein there are four guide projections 17 in the exemplary embodiment, which extend on the inside of the longitudinal end 16 toward the open side of the covering cap 9. When in the snap-in position (see FIG. 10, for example), the guide projections 17 of the covering cap 9 bear on a guide surface 18 of the attachment element 7 formed on the longitudinal end 16. Accordingly, the guide surface 18 is complementary to the shape of the guide projection 17. When the snap-fit hook 10 is then disengaged at the longitudinal end 15 from the snap-fit recess 11, the longitudinal end 15 of the covering cap 9 can then be moved in relation to the attachment element 7, as is shown in FIG. 12. The complementary design of the guide surface 18 to the guide projections 17 enables a forced movement when the covering cap 9 is released, in which the attachment element 7 guides, or forcibly guides, the movement of the covering cap 9, such that the guide projections 17 move along the complementary guide surface 18, and away from the attachment element 7. As can be seen in FIG. 6, 7, 10 or 12, the guide surface 18 of the attachment element 7 and the guide projections 17 of the covering cap 9 are designed such that they are arched, or curved, respectively, by means of which the pivotal movement of the covering cap 9 shown in FIGS. 3 and 12 is obtained. This pivotal movement is facilitated in that the attachment element 7 has a support 19 on its longitudinal end 16, on which at least one section of a longitudinal end 16 of the covering cap lies. The support 19 and the guide surface 18, which is formed adjacent to the support 19, and is parallel thereto, form, collectively, a pivot bearing 20 for the covering cap 9. Consequently, the covering cap 9 is supported such that it can pivot about the pivot bearing 20 in relation to the lock cylinder 5, such that it is effectively prevented that the covering cap 9 can strike against the panel of the door 2, and possibly damage the paint on the door 2, when the covering cap 9 is moved, for example, in the case of an emergency, from the snap-in position, and removed.

In order that the covering cap 9, when in its snap-in position, in addition to the securing at the one longitudinal end 15, is also secured at the other longitudinal end 16, there are three elastically deformable locking arms 21 provided in the interior of the covering cap 9 (see FIG. 8, for example), which have a hook-shaped free end 23. The hook-shaped free ends 23 of the elastic locking arms 21 engage with corresponding locking recesses 22 formed in the attachment element 7 when the covering cap 9 is in the snap-in position. The locking recesses 22 are complementary to the three locking arms 21 of the covering cap 9 in the frame-like structure of the attachment element 7. A movement of the guide projections 17 along the guide surface 18 is blocked by the locking arms 21 until a sufficiently strong force forces the hook-shaped ends 23 of the locking arms 21 out of the locking recesses 22. As can be seen in particular in FIGS. 7, 8 and 9, the three hook-shaped ends 23 each face in different directions, which facilitates the securing of the covering cap 9. As can furthermore be seen in these Figures, the two outer guide projections 17 simultaneously form the two outer locking arms 21 (see FIG. 11, for example), by means of which these guide projections fulfill a double function.

In order to ensure that the covering cap 9 does not strike the door panel 2 due to a tilting movement when it is being dismantled from the handle unit 1, the attachment element 7 furthermore has two movement limiting bars 24, between which two movement limiting projections 25 of the covering cap 9 are disposed, such that a movement of the covering cap 9 transverse to the direction of the forcibly guided movement is blocked when releasing the covering cap 9 (see FIG. 11), by means of which a tilting of the covering cap 9 is prevented when it is released from the handle unit 1. The two outer locking arms 21 of the covering cap 9 also each form a type of movement limiting projection 25 (see FIG. 11), each of which bears on corresponding outer movement limiting bars 24, by means of which a tilting of the covering cap 9 is prevented when it is dismantled.

Figure 13:
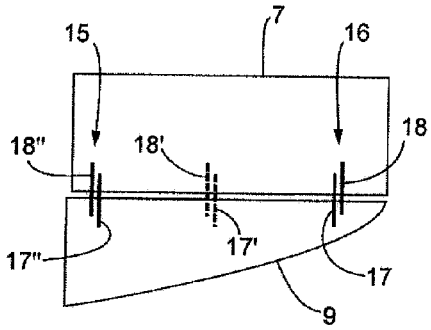
FIG. 13 shows an alternative embodiment having a secondary guide surface and secondary guide projection in a schematic sectional view.

A second embodiment of the invention is shown in FIG. 13, which differs from the first embodiment in that here an additional guide for the covering cap 9 is provided. This additional guide can be formed at either the longitudinal end 15 and/or in the middle of the covering cap 9, as is shown in FIG. 13. The guide formed in the middle is formed by a secondary guide projection 17' of the covering cap 9 and a secondary guide surface 18' of the attachment element 7, while in contrast, with an additional guide on the longitudinal end 15, the guide is formed by a secondary guide projection 17" of the covering cap 9 and a secondary guide surface 18" of the attachment element 7. The projections 17, 17', 17" and 18, 18', 18" are not arched or curved, as in the first exemplary embodiment, but rather, they are straight, such that when dismantled, a straight movement of the covering handle 9 away from the handle unit 1 occurs. For the second exemplary embodiment it is the case that in general, in addition to the at least one guide projection 17, formed on the longitudinal end 16 of the cover cap 9, the secondary guide projection 17', 17" is formed in the middle of the covering cap 9 and/or on the longitudinal end 15 of the covering cap 9 lying opposite the guide projection 17, wherein the attachment element 7 has a secondary guide surface 18', 18", which is complementary to the secondary guide projection 17', 17", and by which the secondary guide projection 17', 17" is guided when releasing the covering cap 9.

In summary, a handle unit 1 for a moving part of a vehicle, in particular for a door 2 or a hatch 2, is described above. The handle unit 1 comprises a moving handle element 4 for opening and/or closing a lock provided on the moving part, the cylinder lock 5, which is protected toward the exterior by means of the covering cap 9, and the attachment element 7, on which the covering cap 9 is releasably disposed. The attachment element 7 has at least one elastic snap-fit hook 10 and the covering cap 9 has at least one snap-fit recess 11, wherein the at least one snap-fit hook 10 is complementary to the at least one snap-fit recess 11, and engages therewith when the covering cap 9 is in a snap-in position. It is provided according to the invention that the covering cap 9 has at least one guide projection 17 on its interior, which bears on a guide surface 18 when in the snap-in position, which is formed on the attachment element 7, and is complementary to the guide projection 17, wherein the attachment element 7 forcibly guides the movement of the covering cap 9 when releasing the covering cap 9, such that the at least one guide projection 17 moves along the complementary guide surface 18, away from the attachment element 7. The advantage to be seen in this design in comparison with the designs known from the prior art is that the covering cap 9 is not immediately released from the handle unit when rotated during the dismantling, such that it falls onto the ground. The guide furthermore ensures that the pointed longitudinal end of the covering cap 9 does not move against the panel of the vehicle body, damaging the paint or the panel. On the contrary, the guide according to the invention ensures that the covering cap 9 is guided away from the panel. Moreover, the invention presented herein provides for a more secure attachment of the covering cap to the handle unit than the solutions known form the prior art. It is to be understood that not only one guide, but also a second or even a third guide may be provided, as is shown in the exemplary embodiment shown in FIG. 13, and described above.

The invention described above is, as a matter of course, not limited to the embodiments described and depicted herein. It is clear that numerous modifications, obvious to the person skilled in the art with regard to the intended use, could be made to the embodiments depicted in the drawings, without abandoning the scope of the invention thereby. By way of example, it is sufficient when, instead of numerous guide projections 17, just one is provided for implementing the guided movement of the covering cap out of the snap-in position. Everything contained in the description and/or depicted in the drawings belongs to the invention, including that which is obvious to the person skilled in the art, deviating from the concrete exemplary embodiments.

The invention claimed is:

1. A handle unit for a vehicle, comprising a handle mount, a moving handle element, a lock cylinder, which is attached to the handle mount and protected toward the exterior by a covering cap, and an attachment element, on which the covering cap is releasably disposed and which attaches the lock cylinder to the handle mount, wherein the handle element interacts with the lock cylinder, such that when the lock cylinder is locked, the handle element cannot be effectively operated, wherein the attachment element has at least one elastic snap-fit hook and the covering cap has at least one snap-fit recess, wherein the at least one snap-fit hook is designed such that it is complementary to the at least one snap-fit recess, and engages therewith when the covering cap is in a snap-in position, wherein the covering cap has at least one guide projection on the inside, which bears on at least one guide surface when in the snap-in position, which is formed on the attachment element and is complementary to the at least one guide projection, wherein the at least one snap-fit hook is disengaged from the at least one snap-fit recess when the covering cap is released, and wherein the attachment element forcibly guides movement of the covering cap when the covering cap is released, such that the at least one guide projection moves along the at least one complementary guide surface and away from the attachment element.

2. The handle unit according to claim 1, wherein the at least one guide surface of the attachment element and the at least one guide projection of the covering cap are designed such that they follow a curve.

3. The handle unit according to claim 1, wherein the attachment element has a support on one of its longitudinal ends, on which at least one section of a longitudinal end of the covering cap bears.

4. The handle unit according to claim 3, wherein the support and the at least one guide surface, which is disposed adjacent to the support and runs substantially parallel thereto, collectively form a pivot bearing for the covering cap, about which the covering cap is pivotably supported in relation to the lock cylinder.

5. The handle unit according to claim 1, wherein the attachment element has at least two movement limiting bars, between which at least one movement limiting projection of the covering cap is disposed, wherein the at least two movement limiting bars block a movement of the covering cap transverse to the direction of the forcibly guided movement when releasing the covering cap.

6. The handle unit according to claim 1, wherein at least one elastic, moveable locking arm is formed in the interior of the covering cap, which engages with a locking recess, which is formed on the attachment element and is complementary to the at least one locking arm, such that a movement of the at least one guide projection along the at least one guide surface is blocked.

7. The handle unit according to claim 1, wherein the attachment element has a housing for accommodating the lock cylinder.

8. The handle unit according to claim 1, wherein, in addition to the at least one guide projection, formed on a longitudinal end of the covering cap, a secondary guide projection is formed in the middle of the covering cap, or on a longitudinal end of the covering cap lying opposite the at least one guide projection, wherein the attachment element has a secondary guide surface, which is designed such that it is complementary to the secondary guide projection, and by which the secondary guide projection is guided when releasing the covering cap.

9. The handle unit according to claim 1, wherein the attachment element is releasably attached to the handle mount for the handle unit, or is designed as a component of the handle mount for the handle unit.

10. The handle unit according to claim 1, wherein an opening is formed in the covering cap, through which a tool can be inserted into the interior of the covering cap, such that the at least one elastic snap-fit hook can be released from its snap-in position such that the at least one elastic snap-fit hook is disengaged from the at least one snap-fit recess, and the covering cap can be released from the handle unit.

* * * * *